United States Patent [19]

Fujiyoshi et al.

[11] Patent Number: 4,919,089

[45] Date of Patent: Apr. 24, 1990

[54] VALVE OPERATING SYSTEM FOR INTERNAL COMBUSTION ENGINE

[75] Inventors: Yoshihiro Fujiyoshi; Hidenobu Nagase; Koichi Fukuo; Takatoshi Aoki, all of Saitama, Japan

[73] Assignee: Honda Giken Kogyo Kabushiki Kaisha, Tokyo, Japan

[21] Appl. No.: 273,202

[22] Filed: Nov. 17, 1988

[30] Foreign Application Priority Data

Nov. 19, 1987 [JP] Japan ..... 62-292621
Oct. 5, 1988 [JP] Japan ..... 63-251526

[51] Int. Cl.[5] ..... F01L 1/34; F01L 1/14

[52] U.S. Cl. ..... 123/90.16; 123/90.55

[58] Field of Search ..... 123/90.12, 90.13, 90.16, 123/90.48, 90.49, 90.55, 90.56, 90.57, 90.58, 90.59

[56] References Cited

U.S. PATENT DOCUMENTS

| | | | |
|---|---|---|---|
| 2,522,185 | 9/1950 | Manly | 123/90.12 |
| 3,257,999 | 6/1956 | Fiedler | 123/90.12 |
| 4,106,446 | 8/1978 | Yamada et al. | 123/90.13 |
| 4,153,016 | 5/1979 | Hausknecht | 123/90.55 |
| 4,365,595 | 12/1982 | Piatti | 123/90.53 |
| 4,452,186 | 6/1984 | List et al. | 123/90.55 |
| 4,483,283 | 11/1984 | Hausknecht | 123/90.16 |
| 4,671,221 | 6/1987 | Geringer et al. | 123/90.16 |
| 4,674,451 | 6/1987 | Rembold et al. | 123/90.16 |
| 4,696,265 | 9/1987 | Nohira | 123/90.55 |

FOREIGN PATENT DOCUMENTS

| | | |
|---|---|---|
| 751538 | 11/1952 | Fed. Rep. of Germany . |
| 243908 | 2/1947 | Switzerland . |

*Primary Examiner*—Charles J. Myhre
*Assistant Examiner*—Weilun Lo
*Attorney, Agent, or Firm*—Lyon & Lyon

[57] ABSTRACT

A valve-operating system for an internal combustion engine, which system includes a valve-driving piston slidably received in a cylinder body and operatively connected at one end of the piston to an engine valve spring-biased in a closing direction. A check valve and an orifice are interposed between a hydraulic pressure generating means for generating an oil pressure for causing opening of the engine valve and a damper chamber defined between the cylinder body and the valve-driving piston. The check valve permits only the flow of working oil from the hydraulic pressure generating means to the damper chamber. The orifice restricts the return of working oil from the damper chamber to the hydraulic pressure generating means. The orifice is made sufficiently short relative to its width to reduce the influence due to viscosity variations of the working oil to an extremely small level.

16 Claims, 15 Drawing Sheets

VALVE OPERATING SYSTEM FOR INTERNAL COMBUSTION ENGINE

FIELD OF THE INVENTION

The present invention relates to a valve-operating system for an internal combustion engine and, in particular, to a hydraulically operated system wherein a valve-driving piston is slidably received in a cylinder body and the piston is operatively connected at one end to an engine valve that is spring-biased in a closing direction.

DESCRIPTION OF THE PRIOR ART

A similar valve-operating system has been conventionally known, for example, from Japanese Patent Publication No. 35813/77, wherein a check valve and an orifice are interposed between a hydraulic pressure generating means for generating an oil pressure in response to opening of the engine valve and a damper chamber defined between the cylinder body and the valve-driving piston, and wherein the check valve is for permitting only the flow of working oil from the hydraulic pressure generating means to the damper chamber, and the orifice is for restricting the return of the working oil from the damper chamber to the hydraulic pressure generating means. By restricting the flow rate of the working oil returned from the damper chamber into the hydraulic pressure generating means by an orifice during closing operation of the intake or exhaust valve of an engine, the speed of closing of the intake or exhaust valve is slowed down, thereby moderating any shock during seating to prevent any damage of the intake or exhaust valve or the valve seat. With this prior art system, however, the viscosity of the working oil is not taken into consideration, and the speed of operation of the valve-driving piston will be changed or varied due to a variation in viscosity depending upon the temperature of the working oil.

SUMMARY OF THE INVENTION

It is an object of the present invention to provide a valve-operating system for an internal combustion engine wherein the speed of operation of the valve-driving piston during closing of the valve can be controlled to a constant level despite any variation in viscosity of the working oil.

One manner of attaining the above object, according to a preferred embodiment of the present invention, is to make the orifice sufficiently short to reduce the influence due to the viscosity of the working oil to an extremely small level.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 3 illustrate a first embodiment of the valve-operating mechanism of the present invention, wherein FIG. 1 is an overall longitudinal sectional side view;

FIG. 2 is an enlarged longitudinal sectional view of an essential portion of FIG. 1; and FIG. 3 is a sectional view taken along a line III—III in FIG. 2;

FIGS. 7 to 11 illustrate a fifth embodiment of the present invention, wherein FIG. 7 is a longitudinal sectional view similar to FIG. 2;

FIG. 8 is an enlarged perspective view of a valve-driving piston;

FIG. 9 is a graph illustrating a relationship between the amount of lift of a valve and the opening area for returning of the working oil;

FIG. 10 is a graph of a valve lift characteristic; and

FIG. 11 is a graph of an oil pressure characteristic of a damper chamber;

FIGS. 14 to 16 illustrate a seventh embodiment of the present invention, wherein FIG. 14 is a longitudinal sectional view similar to FIG. 2;

FIG. 15 is an enlarged perspective view of a valve-driving piston; and

FIG. 16 is a graph of a valve lift characteristic; and

DESCRIPTION OF THE PREFERRED EMBODIMENTS

Figure 1:
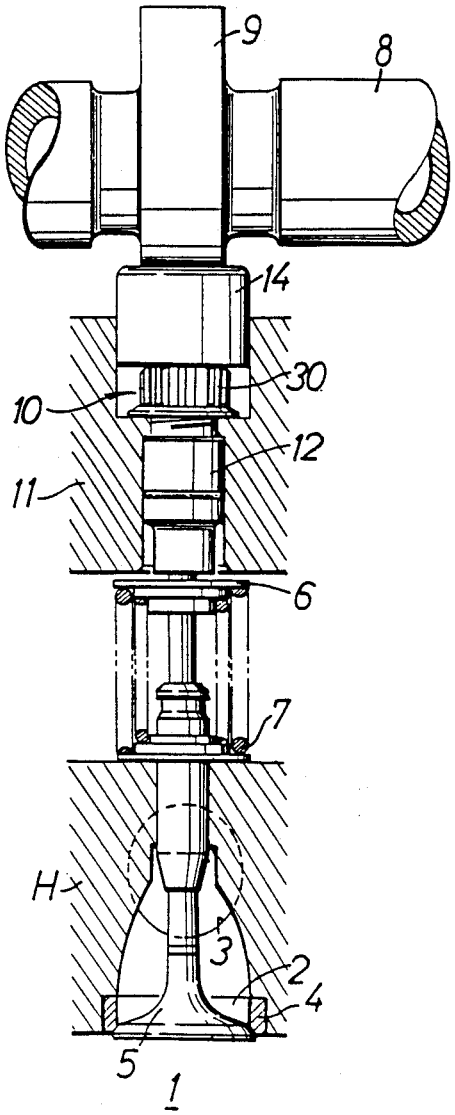

The present invention will now be described in connection with preferred embodiments with reference to the drawings. Referring first to FIG. 1, the basic valve-operating mechanism is illustrated that is applicable to each of the eight embodiments. The mechanism will be described as being applied to an intake valve but it will be understood that it is equally applicable to an exhaust valve of an internal combustion engine . As shown in FIG. 1, a cylinder head H of an internal combustion engine is provided with an intake valve bore 2 communicating with an intake port 3 and opened in the ceiling surface of the combustion chamber 1 defined between the cylinder head and a cylinder block which is not shown. An intake valve 5 in the form of an engine valve capable of seating on a ring-like valve seat member 4 fixedly mounted in the intake valve bore 2 is vertically and movably guided by a bore in the cylinder head H to open and close the intake valve bore 2. Further, a valve spring 7 is mounted in compression between a flange 6 mounted on an upper end of the intake valve 5 and the cylinder head H, so that the intake valve 5 is biased upwardly, i.e., in a closed direction by a spring force of the valve spring 7. Above the cylinder head H, there is disposed a cam shaft 8 driven for rotation by a crank shaft (not shown). A hydraulic pressure generating means 10, including a cam 9 formed on the cam shaft 8, is disposed above the intake valve 5 to generate a hydraulic pressure for driving the intake valve 5 for opening and closing it depending upon the profile of the cam 9.

Figure 2:
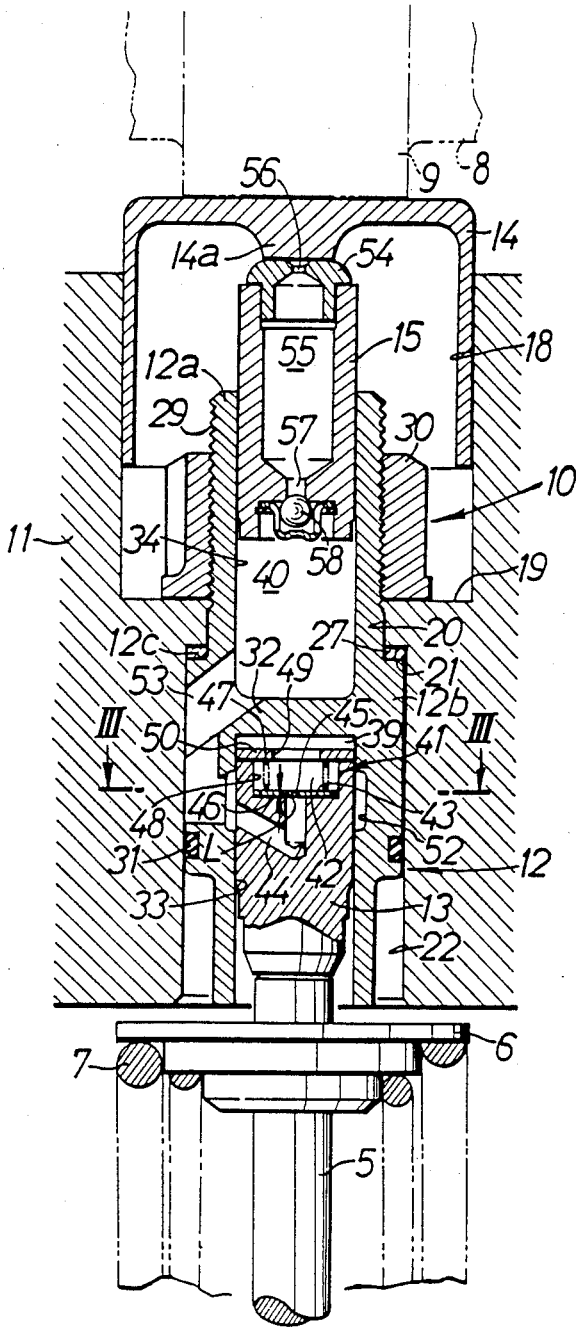

Referring to FIG. 2, the hydraulic pressure generating means 10 comprises the cam 9, a cylinder body 12 fixedly mounted in a support 11 and coaxial with the operational axis of the intake valve 5 in a location above the intake valve 5, a lifter 14 in slidable contact with the cam 9 and slidably received in an upper portion of the support 11, and a cam follower piston 15 slidably received in an upper portion of the cylinder body 12 with its upper end abutting against the lifter 14. The support 11 is securely mounted on the cylinder head H.

Above the intake valve 5, the support 11 is provided, in sequence downwardly from the top, with a first bore 18, a second bore 20 smaller in diameter than the first bore 18 and connected to a lower end of the first bore 18 through a step 19, and a third bore 22 larger in diameter than the second bore 20 and connected to a lower end of the second bore 20 through a step 21. The bores 18, 20 and 22 extend vertically and coaxially with the intake valve 5.

The cylinder body 12 is basically formed into a cylindrical configuration and includes a smaller diameter portion 12*a* sized such that it may be inserted through the second bore 20, and a larger diameter portion 12*b* sized such that it may be fitted into the third bore 22, these smaller and larger diameter portions being coaxially interconnected through a step 12*c* facing upwardly. The larger diameter portion 12*b* of the cylinder body 12 is fitted in the third bore 22 so that the smaller diameter portion 12*a* is inserted through the second bore 20, with a shim 27 interposed between the step 12*c* and the aforesaid step 21. Exterior threads are provided on that portion of the smaller diameter portion 12*a* which projects above the second bore 20, and by tightening a nut 30 screwed over the external threads 29 until it abuts against the step 19, the cylinder body 12 is locked to the support 11. In addition, an annular sealing member 31 is fitted on an outer surface of the large diameter portion 12*b* of the cylinder body 12 to achieve a sealing between such outer surface and an inner surface of the third bore 22.

A partition wall 32 is provided at the middle of the cylinder body 12 for partitioning the interior of the cylinder body 12 into a lower cylinder bore 33 and an upper cylinder bore 34. The cam follower piston 15 is slidably received in the upper cylinder bore 34 to define a working oil chamber 40 between the piston and the partition wall 32. A valve-driving piston 13 abutting against an upper end of the intake valve 5 is slidably received in the lower cylinder bore 33 to define a damper chamber 39 between the piston 13 and the partition wall 32.

Figure 3:
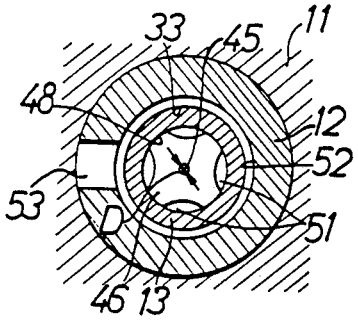

Referring also to FIG. 3, a check valve 41 is provided in the valve-driving piston 13 for permitting only the flow of a working oil from the working oil chamber 40 into the damper chamber 39. The check valve 41 is contained and disposed in a valve chest 42 provided in the valve-driving piston 13 in communication with the damper chamber 39, and comprises a flat valve plate 46 contained in the valve chest 42 for seating on a seat surface 43 provided in the valve-driving piston 13 and facing the valve chest 42, and a spring 47 contained in the valve chest 42 to bias the valve plate 46 toward the seat surface 43.

The valve-driving piston 13 is also provided with an oil passage 44 opened in a central portion of the seat surface 43 and communicating with the working oil chamber 40.

A bottomed hole 48, whose closed end functions as the seat surface 43, is coaxially provided in one end of the valve-driving piston 13 and an end plate 50 having a communication hole 49 at its central portion is fixedly mounted on a top end of the valve-driving piston 13 to cover an opened end of the bottomed hole 48. Thus, the valve chest 42 is defined in an upper end portion of the valve-driving piston 13 to communicate with the damper chamber 39. Notches are provided in an outer edge of the valve plate 46 at circumferentially uniformly spaced apart distances to provide a plurality of passages 51 between the valve plate 46 and an inner surface of the bottomed hole 48. The spring 47 is mounted in compression between the end plate 50 and valve plate 46.

The valve plate 46 is centrally provided with an orifice 45 leading to the oil passage 44. Furthermore, in order to reduce the influence due to the viscosity of the working oil to an extremely small level, the orifice 45 is designed to provide a small ratio $L/D^2$ of 3 or less, for example, the length L to area $D^2$, wherein D is the diameter of the orifice and L is the axial length of the orifice, and hence, the valve plate 46 is formed with a small thickness.

The oil passage 44 is provided in the valve-driving piston 13, with one end opened in a central portion of the seat surface 43 in communication with the orifice 45 in the valve plate 46 and with the other end opened in an outer side surface of the valve-driving piston 13. The lower cylinder bore 33 in the cylinder body 12 is also provided with an annular recess 52 communicating with the other end of the oil passage 44 regardless of the angular position of the valve-driving piston 13. Moreover, the annular recess 52 is provided in the inner surface of the lower cylinder bore 33 to communicate with the damper chamber 39 when the valve-driving piston 13 is moved downwardly and the intake valve 5 is in a condition of from its fully opened state to the middle of a closing operation, and to communicate with the oil passage 44 when the intake valve 5 is in a condition of from the middle of the closing operation to its fully closed state. Further, the cylinder body 12 is machined to provide an oil passage 53 in cooperation with the inner surface of the lower cylinder bore 33 for communication between the working oil chamber 40 and the annular recess 52.

The cam follower piston 15 is formed of a bottomed cylinder with its closed end down. An upper open end of the cam follower piston 15 is closed by a closing member 54 capable of abutting against the lifter 14. The lifter 14 is also formed of a bottomed cylinder slidably received in the first bore 18 with an outer surface of its closed end in slidable contact with the cam 9. Moreover, the lifter 14 is provided at a central portion of an inner surface of its closed end with an abutment projection 14*a* abutting against the closing member 54 of the cam follower piston 15.

An oil storage chamber 55 is inside the cam follower piston 15 and closed by the closing member 54. A through hole 56 is provided in the closing member 54, through which the working oil stored in the storage chamber 55 is passed to the portion which is in slidable contact with the lifter 14. In addition, the cam follower piston 15 is provided at its closed end with an oil hole 57 adapted to communicate with the working oil chamber 40, and a check valve 58 is disposed in the oil hole 57 for permitting only the flow of the working oil from the storage chamber 55 toward the working oil chamber 40.

The operation of this embodiment now will be described. When the intake valve 5 is in its fully closed state, the hydraulic pressure generating means 10 is in a state as shown in FIG. 2. For opening the valve 5, the lifter 14 is pushed down from this state shown in FIG. 2 by the cam 9 in response to rotation of the cam shaft 8. This causes the cam follower piston 15 to be urged downwardly, thereby reducing the volume of the working oil chamber 40, so that the working oil within the working oil chamber 40 is passed via the oil passage 53 into the oil passage 44 and further via the orifice 45 into the damper chamber 39. At this time, a downward force provided by a hydraulic pressure in the damper chamber 39 and by the spring 47 and an upward force provided by the hydraulic pressure introduced through the oil passage 44 act on the valve plate 46 of the check valve 41, and when the upward force has become larger than the downward force, the valve plate 46 is moved away from the seat surface 43, so that the working oil from the oil passage 44 is introduced rapidly into the damper chamber 39 via the passages 51 Thus, the oil pressure in the damper chamber 39 is increased, thereby causing the valve-driving piston 13 to be forced down. In the course of the downward sliding movement of the valve-driving piston 13, the oil passage 53 is put into communication with the damper chamber 39 through the annular recess 52, so that the amount of pressurized oil flowing into the damper chamber 39 is further increased, thereby causing the valve-driving piston 13 to be further forced down. This allows the intake valve 5 to be opened against the spring force of the valve spring 7.

After the intake valve 5 has been driven to the fully open state, and when the downward urging force on the lifter 14 by the cam 9 is released, the intake valve 5 is driven upwardly, i.e., in a closing direction by the spring force of the valve spring 7. The closing operation of the intake valve 5 also causes the valve-driving piston 13 to be pushed up, so that the working oil in the damper chamber 39 is returned to the working oil chamber 40 via the oil passage 53. However, in the course of such valve-closing operation and after the direct communication between the annular recess 52 and the damper chamber 39 is cut off by the upward movement of piston 13, the check valve 41 and the orifice 45 intervene between the damper chamber 39 and the annular recess 52, communicating with the working oil chamber 40, whereby the amount of working oil flowing from the damper chamber 39 back to the working oil chamber 40 is limited. Specifically, in the check valve 41, the downward force on the valve plate 46 becomes larger than the upward force, thereby allowing the valve plate 46 to seat on the seat surface 43, so that the damper chamber 39 and the working oil chamber 40 are put into communication with each other only through the orifice 45. The restricting effect of the orifice 45 allows the amount of working oil flowing from the damper chamber 39 back to the working oil chamber 40 to be limited. Consequently, the speed of upward or closing movement of the intake valve 5 is slowed down in the final portion of the valve-closing operation, so that the intake valve 5 slowly seats on the valve seat member 4. Accordingly, it is possible to moderate the shock during seating to prevent any damage of the intake valve 5 and the valve seat member 4 or the like to the utmost.

Now, considering a pressure loss due to the viscosity resistance in the orifice 45, a differential pressure $\Delta P$ across the orifice 45 due to the viscosity resistance requires consideration of the friction of a fluid in the form of laminar flow and is represented by the following equation (1) according to well known Hagen-Poiseuille law wherein the viscosity coefficient is represented by $\mu$, and the average speed of a working oil flowing through the orifice 45 is represented by V:

$$\Delta P = \frac{32\mu\, VL}{D^2} \tag{1}$$

As apparent from the equation (1), the differential pressure $\Delta P$ due to the viscosity resistance can be reduced by reducing the ratio $L/D^2$ of the axial length L to the area $D^2$ which is proportional to the area of the orifice 45, i.e., practically by reducing the thickness of the valve plate 46, i.e. the length L. Thus, the influence on the rate of working oil returning from the damper chamber 39 into the working oil chamber 40 due to the variation in viscosity of the working oil can be reduced by reducing the thickness of the valve plate 46. Therefore, it is possible to ensure a substantially constant speed of operation of the valve-driving piston 13 in the valve closing direction regardless of the variation in viscosity of the working oil.

On the basis of the results of experiments made by the present inventors, it has been confirmed that the speed of the valve-driving piston 13 in the valve-closing direction could be kept constant regardless of the variation in viscosity of the working oil by establishing $L/D^2 \leqq 3$.

Figure 4:
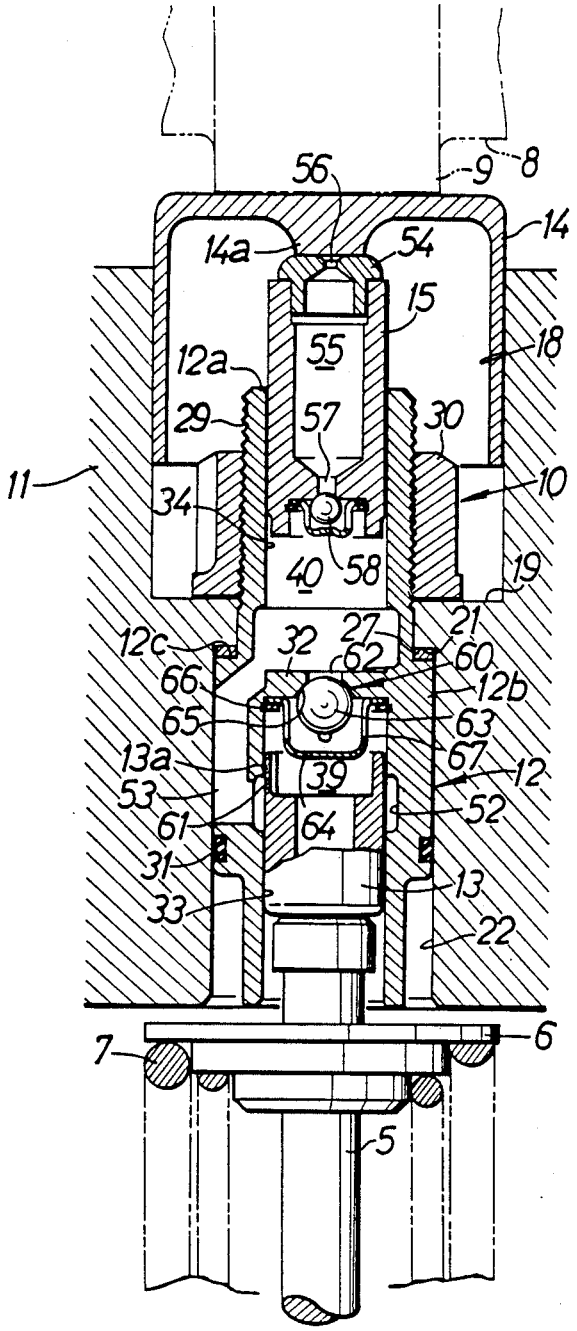
FIGS. 4, 5 and 6 are longitudinal sectional views similar to FIG. 2 for illustrating second, third and fourth embodiments of the present invention; respectively.

FIG. 4 illustrates a second embodiment of the present invention, wherein the portions and elements corresponding to those in the previous first embodiment are designated by the same reference characters and will not be described in detail again.

The partition wall 32 in the cylinder body 12 is provided with a check valve 60 which permits only the flow of working oil from the working oil chamber 40 into the damper chamber 39. The valve-driving piston 13 is provided with an orifice 61 in the side wall of the piston for restricting the amount of working oil returned form the damper chamber 39 into the oil passage 53 during final operation of the valve-driving piston 13 in the valve closing direction.

The check valve 60 comprises a valve bore 62 made in the partition wall 32 between the working oil chamber 40 and the damper chamber 39, a valve ball 63 capable of closing the valve bore 62 from the side of the damper chamber 39, and a hat-like retainer 64 fixed to the side of the partition wall 32 closer to the damper chamber 39 to retain the valve ball 63 for opening and closing operation. A valve seat 65, on which the valve ball 63 can seat, is formed hemispherically in correspondence to the valve ball 63 at that end of the valve bore 62 which opens into the damper chamber 39. The retainer 64 is clamped between the partition wall 32 and a retaining ring 66 fitted over the lower cylinder bore portion 33 of the cylinder body 12 and is provided with a plurality of communication holes 67 permitting the communication between the interior of the retainer 64 and the damper chamber 39.

In such check valve 60, the valve ball 63 seats on the valve seat 65 to close the valve when the force for forcing the valve ball 63 upwardly by an oil pressure within the damper chamber 39, i.e., within the retainer 64, overcomes the force for forcing the valve ball 63 downwardly by an oil pressure within the valve bore 62.

The valve-driving piston 13 is basically formed into a bottomed cylinder and has a thin-wall portion 13*a* provided in an upper portion thereof. The orifice 61 is made in the thin-wall portion 13*a*. Moreover, as with the first embodiment, the orifice 61 is formed with a small ratio of the length to the square of the diameter thereof, for example, of 3 or less, and is located to normally communicate with the annular recess 52 communicating with the working oil chamber 40 through the oil passage 53.

Again with this second embodiment, it is possible to moderate the speed of the valve-driving piston 13 in the valve-closing direction by restricting the rate at which working oil is returned from the damper chamber 39 into the working oil chamber 40 by the orifice 61 during operation of the valve-driving piston 13 in the valve-closing direction. Moreover, because of the small ratio of the length to the flowing sectional area of the orifice 61, the influence due to the viscosity of the working oil can be eliminated to the utmost to ensure a substantially constant speed of the valve-driving piston 13 in the valve-closing direction regardless of the variations in the viscosity of the working oil.

Figure 5:
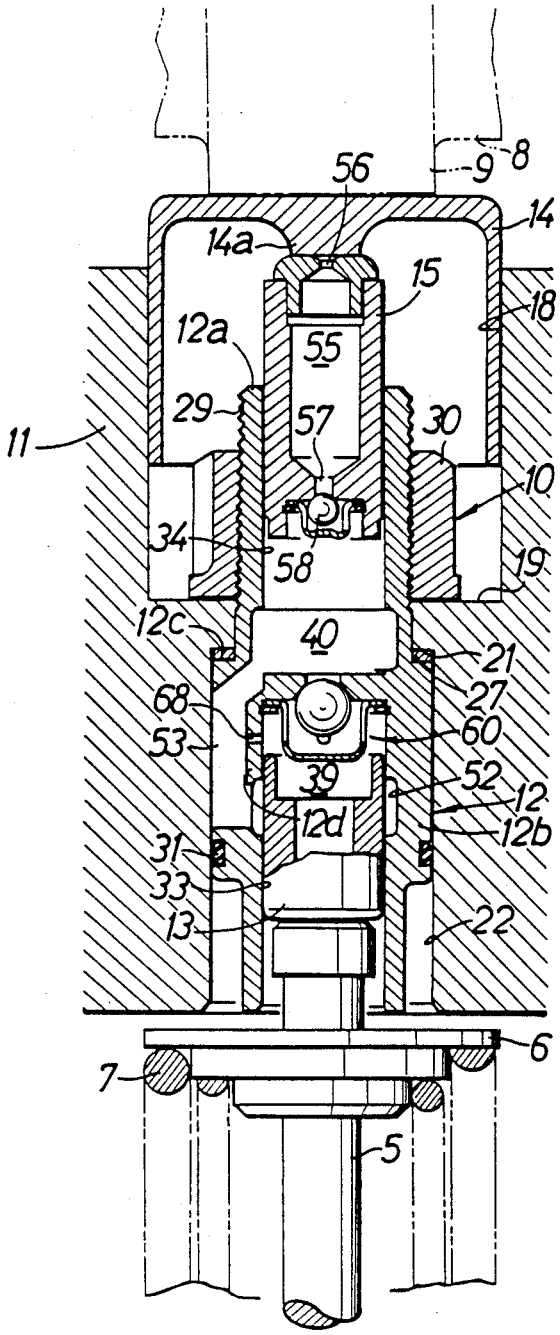

FIG. 5 illustrates a third embodiment of the present invention, wherein the like reference characters are used to denote the portions and elements corresponding to those of the previous embodiments.

A thin-wall portion 12*d* is provided in a portion of the cylinder body 12 facing the oil passage 53 and has an orifice 68 therein to permit the normal communication between the damper chamber 39 and the oil passage 53 despite the moved position of the valve-driving piston 13 within the cylinder body 12. The ratio of the length to a value representative of the flowing sectional area of the orifice 68 is set at a small value, for example, a value of $L/D^2$ of 3 or less.

Again, with the third embodiment, it is possible to moderate the speed of the valve-driving piston 13 in the valve-closing direction as in the first and second embodiments, the influence due to the viscosity of the working oil can be eliminated to the utmost to ensure a substantially constant speed of the valve-driving piston 13 in the valve-closing direction regardless of variations in the viscosity of the working oil.

Figure 6:
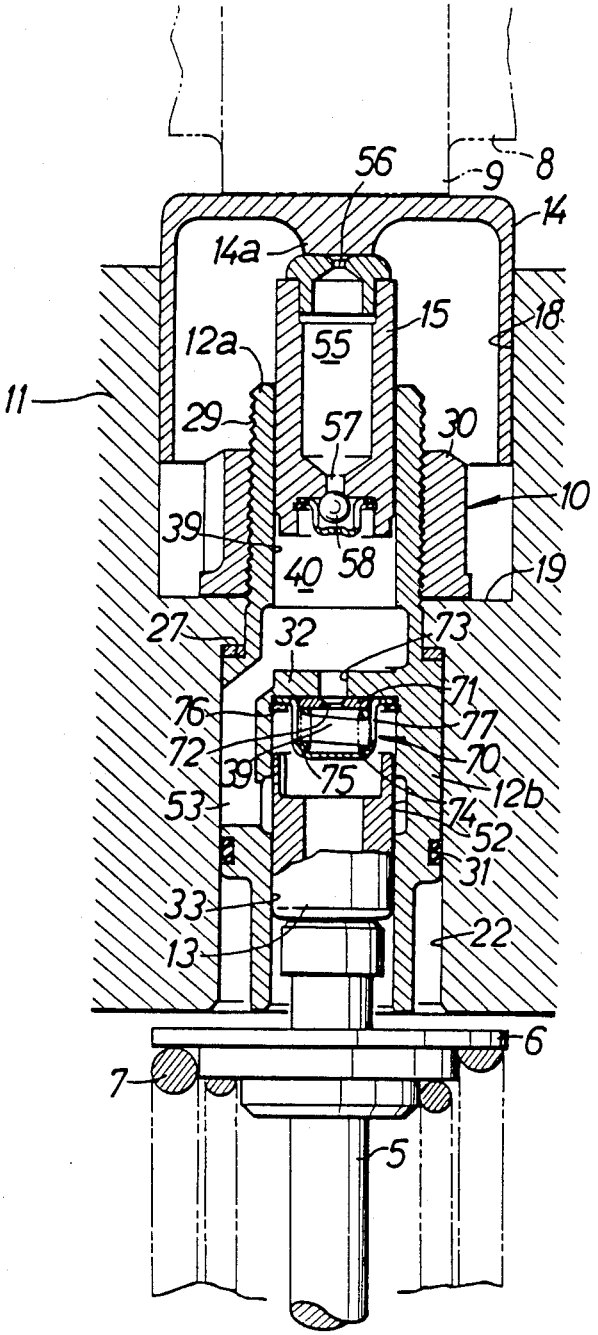
Figure 7:
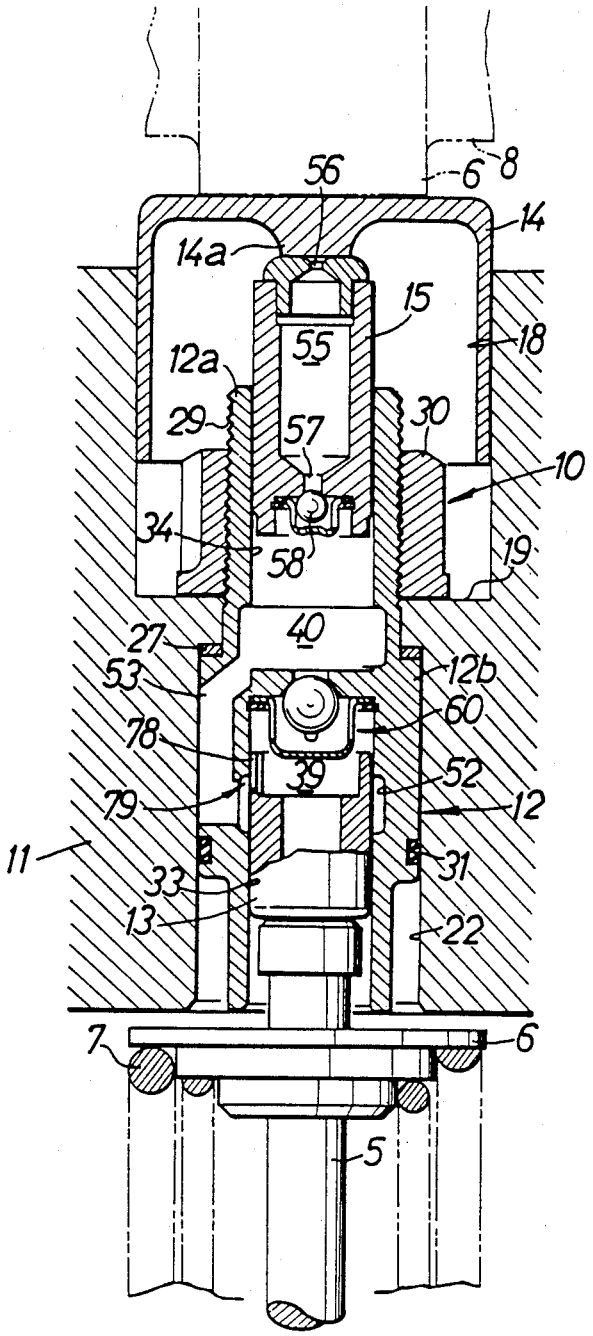

FIG. 6 illustrates a fourth embodiment of the present invention, wherein the like reference characters are used to denote the portions and elements corresponding to those of the previous embodiments.

A check valve 70 is provided in the partition wall 3 for partitioning between the working oil chamber 40 and the damper chamber 39. The check valve 70 comprises a valve bore 73 provided centrally in the partition wall 32 between the damper chamber 39 and the working oil chamber 40, a hat-like retainer 74 fixed to the side of the partition wall 32 closer to the damper chamber 39, a thin valve disk 71 contained in the retainer 74 to open and close the valve bore 73, and a spring 75 mounted in compression between the retainer 74 and the valve disk 71 15 for biasing the valve disk 71 in a closing direction. The retainer 74 is clamped between the partition wall 3 and a retaining ring 76 fitted in a portion, close to the partition wall 32, of the lower cylinder bore 33 of the cylinder body 12. The retainer 74 is provided with a plurality of communication holes 77 for permitting the flow of working oil therethrough.

The valve disk 71 of the check valve 70 is also centrally provided with an orifice 72 permitting the communication between the damper chamber 39 and the valve bore 73 despite the position of the valve disk 71. The orifice 72 is made such that the ratio of the length to the flowing sectional area thereof is of a small value, for example, $L/D^2$ is 3 or less.

Again, with the fourth embodiment, the influence due to the viscosity of the working oil can be eliminated to the utmost to moderate the speed of the valve-driving piston 13 in the valve-closing direction as in the previous embodiments.

FIGS. 7 to 11 illustrate a fifth embodiment of the present invention, wherein the portions and elements corresponding to those of the previous embodiments are designated by the like reference characters.

A notch 78 is provided in a thin-wall portion 13*a* at an upper end of the valve-driving piston 13 to extend axially of the valve-driving piston 13 and constitutes a variable orifice 79 in cooperation with an upper end edge of the annular recess 52 in the cylinder body 12.

Figure 8:
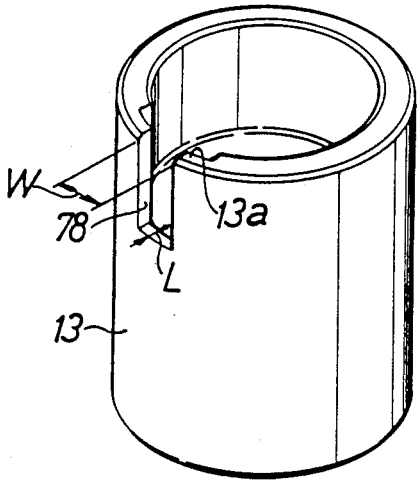

Now, considering the pressure loss due to viscosity resistance in the variable orifice 79, and when the width of the notch 78 is represented by W, and the length thereof in the direction through the thin wall (i.e. the wall thickness) is represented by L, as shown in FIG. 8, the pressure loss $\Delta P$ is represented by the following equation (2):

$$\Delta P = \frac{12\mu L v}{W^2} \tag{2}$$

Accordingly, reduction of $L/W^2$ makes it possible to reduce the influence on the differential pressure $\Delta P$ due to a variation in viscosity of the working oil and the notch 78 constituting the variable orifice 79 is provided such that $L/W^2$ is small, preferably, there is established $L/W^2 \leqq 1$.

By doing so, it is possible to moderate the closing speed for the intake valve 5 by an effect of the variable orifice 79 regardless of the variation in viscosity of the working oil. Moreover, as shown by a solid line in FIG. 9, the rate at which the working oil returns from the damper chamber 39 into the working oil chamber 40 is proportionally reduced from a point when the upper end edge of the valve-driving piston 13 passes an upper end edge of the annular recess 52 during upward movement of the valve-driving piston 13, i.e., during closing of the intake valve 5. This causes the valve-closing speed to be further reduced just before seating of the intake valve 5, as shown by a solid line in FIG. 10, thereby suppressing generation of any shock noise during seating, while restraining a temporary increase in oil pressure in the damper chamber 39 during closing of the valve to a relatively low level, as shown in a solid line in FIG. 11, thereby suppressing the generation of any shock noise attendant on an increase in oil pressure. In contrast, with the previous first to fourth embodiments, the oil pressures are as shown by dotted lines in FIGS. 9 to 11. The valve closing speeds just before seating are larger than that in the fifth embodiment, and the temporary increase in oil pressure in the damper chamber 39 is larger than that in the fifth embodiment.

Figure 12:
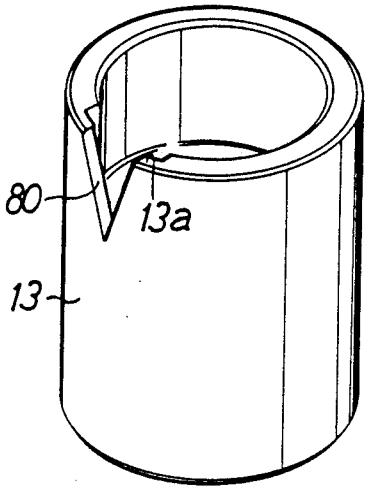
FIG. 12 is a perspective view of a valve-driving piston for illustrating a modification of the fifth embodiment.
Figure 9:
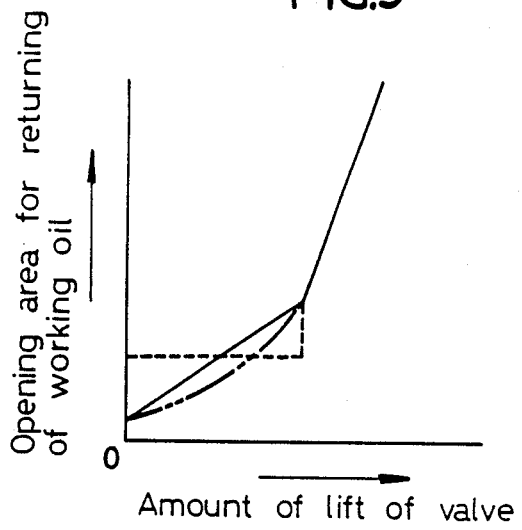
Figure 10:
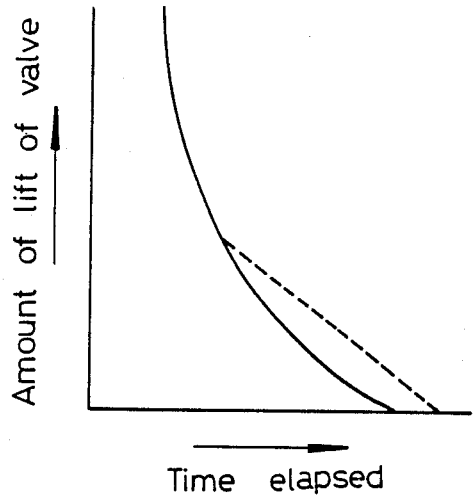
Figure 11:
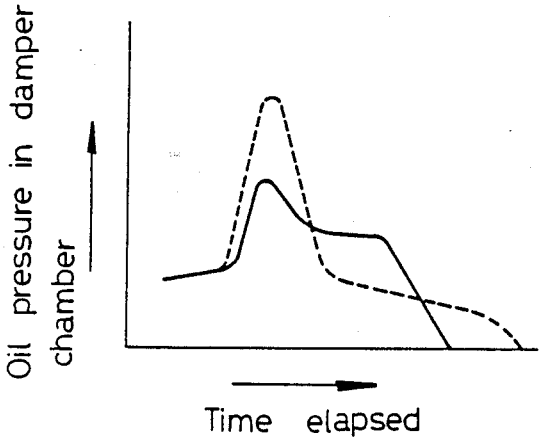

FIG. 12 illustrates a modification of the above fifth embodiment, wherein the thin-wall portion 13*a* at the upper end of the valve-driving piston 13 is provided with a notch 80 of a triangle gradually narrowing in the downward direction, which constitutes a variable orifice in cooperation with the upper end edge of the annular recess 52. By this construction, an opening area for returning working oil during closing of the intake valve 5 is as shown by two-dotted chain line in FIG. 9, making it possible to exhibit an effect similar to that in the fifth embodiment.

Figure 13:
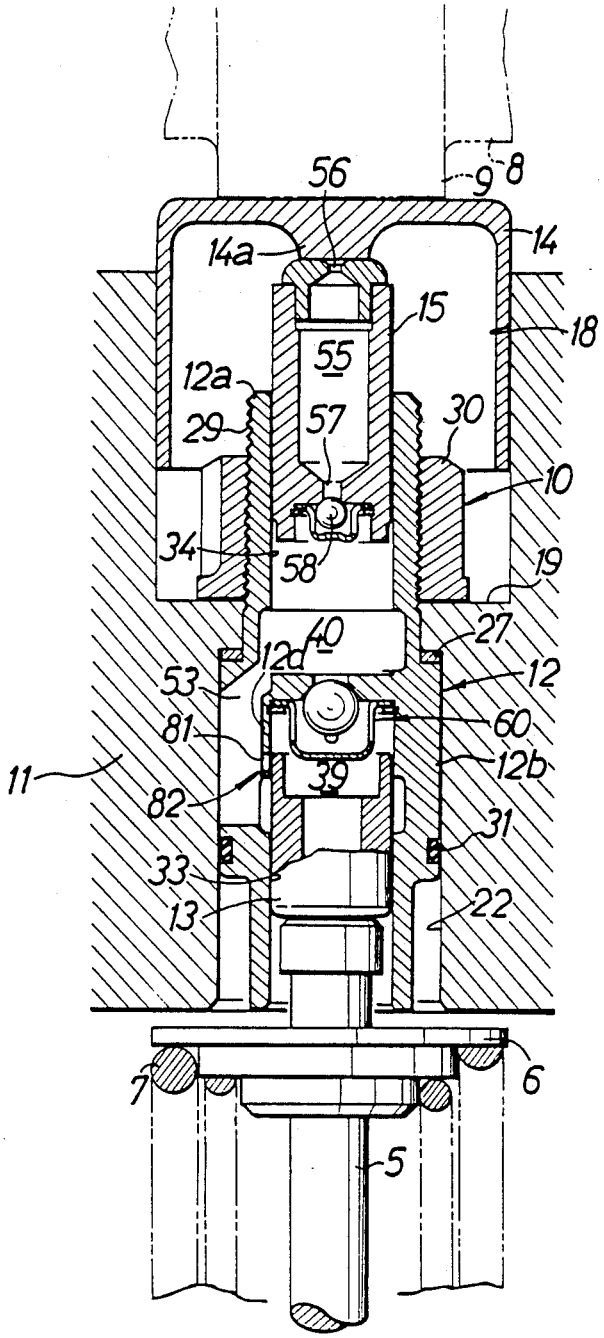
FIG. 13 is a longitudinal sectional view of a sixth embodiment of the present invention, similar to FIG. 2.

FIG. 13 illustrates a sixth embodiment of the present invention, wherein the like reference characters are used to designate the portions and elements corresponding to those in the above-described embodiments.

A thin-wall portion 12*d* of the cylinder body 12 facing the oil passage 53 is provided with a hole 81 which constitutes a variable orifice 82 in cooperation with the upper end edge of the valve-driving piston 13. The hole 81 is made to have a small ratio of the axial length to the flowing sectional area thereof.

With the sixth embodiment, the variable orifice 82 restricts the rate at which working oil returns from the damper chamber 39 into the working oil chamber 40 during operation of the valve-driving piston 13 in the valve-closing direction, and this makes it possible to exhibit an effect similar to that in the above fifth embodiment.

Figure 14:
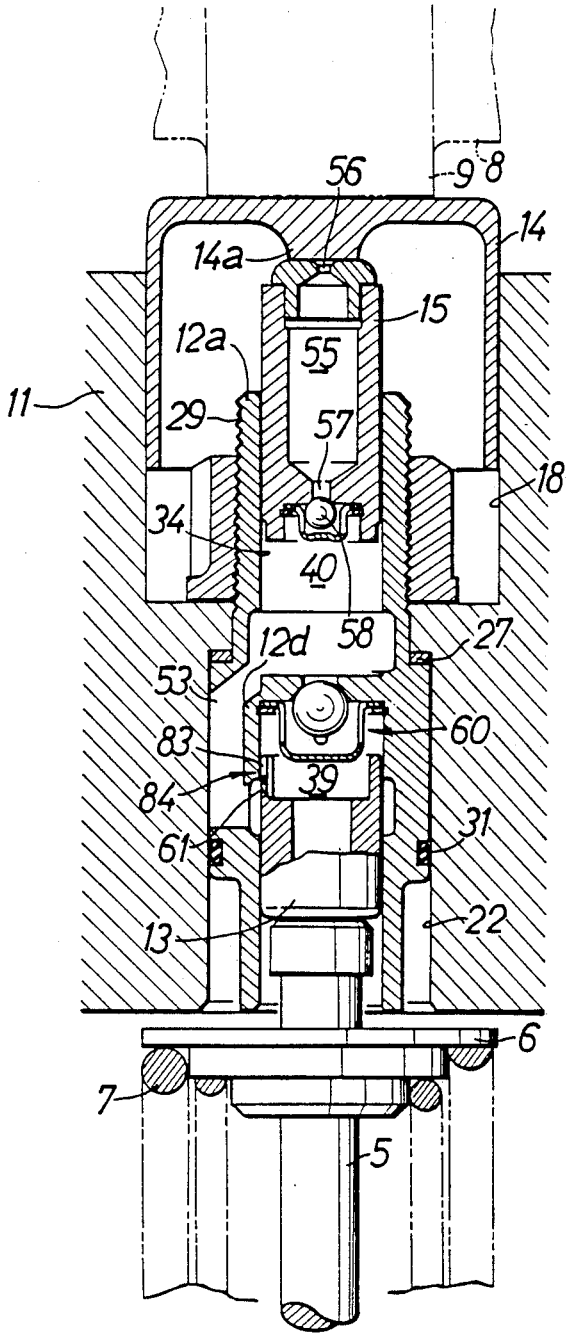
Figure 15:
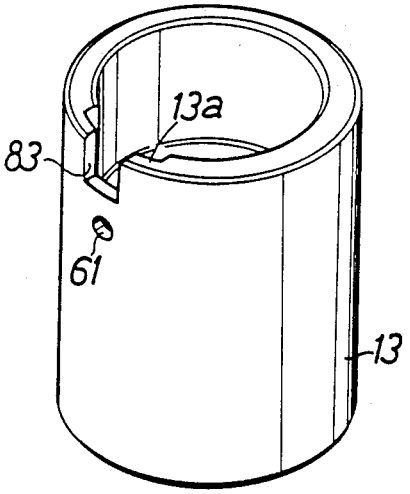
Figure 16:
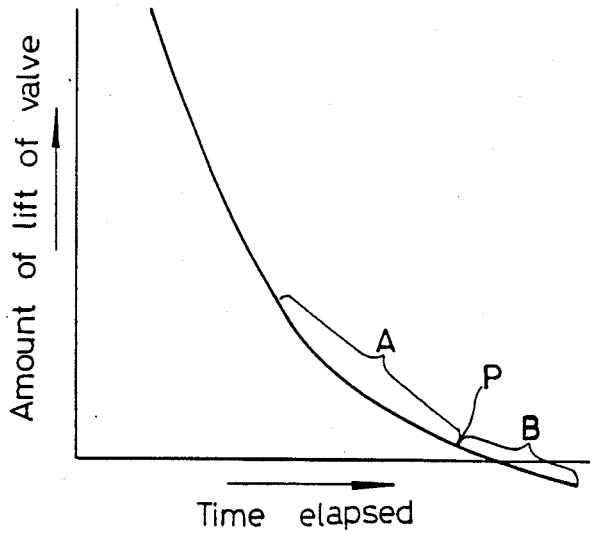

FIGS. 14 to 16 illustrate a seventh embodiment of the present invention, wherein the like reference characters are used to note the portions and elements corresponding to those in the above-described embodiments.

The thin-wall portion 13*a* at the upper end of the valve-driving piston 13 is provided with an invariable orifice 61 permitting the damper chamber 39 to normally communicate with the annular recess 52, and a notch 83 above the invariable orifice 61. The notch 83 and the upper end edge of the annular recess 52 constitute a variable orifice 84. The ratio of the length to the flowing sectional area for each of the invariable and variable orifices 61 and 84 is set at a small value. The variable orifice 84 is established so that the opening area is zero just before seating of the intake valve 5, i.e., the upper end edge of the annular recess 52 is located between the invariable orifice 61 and the notch 83 when the intake valve 5 has seated.

With the seventh embodiment, the working oil in the damper chamber 39 leaks while being restricted by the variable and invariable orifices 84 and 61 in a section indicated by a region A during closing of the intake valve 5, as shown by a solid line in FIG. 16, and in response to such leakage of the working oil, the intake valve 5 is operated to be closed. However, at a point P just before seating of the intake valve 5, the opening area of the variable orifice 84 is zero, and in a section indicated by a subsequent region B, the leakage of the working oil is limited only by a restricting effect of the invariable orifice 61 and hence, in the region B, the inclination of the line indicating the lift of the valve remains approximately level beyond the point P. In addition, it is possible to always maintain the seating speed constant regardless of a shift variation in dimensional accuracy of a valve-operating system, a variation in size due to heat, or a variation due to wear, since the invariable orifice 61 permits the damper chamber 39 and the annular recess 52 to normally and continually communicate with each other.

Figure 17:
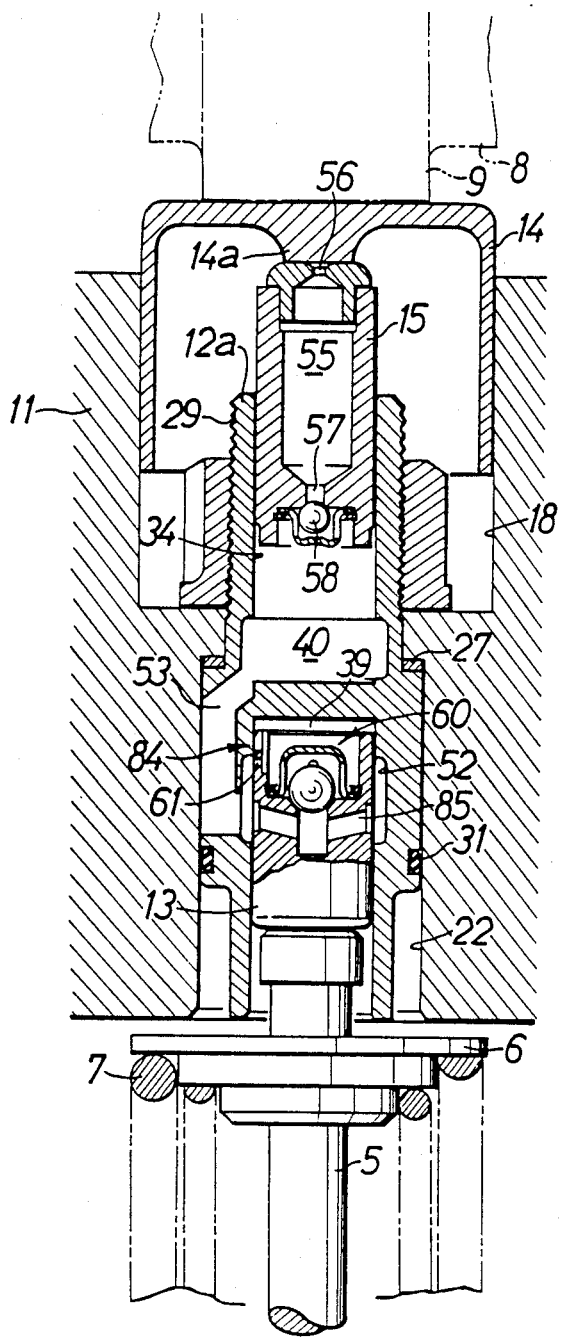
FIG. 17 is a longitudinal sectional view of an eighth embodiment of the present invention, similar to FIG. 2.

FIG. 17 illustrates an eighth embodiment of the present invention, wherein the portions and elements corresponding to those in the previously described embodiments are designated by like reference characters.

In this eighth embodiment, the invariable and variable orifices 61 and 84 are provided as in the above seventh embodiment. The valve-driving piston 13 is provided with an oil passage 85 which normally communicates at its one end with the annular recess 52, and a check valve 60 is mounted at the upper end of the valve-driving piston 13 for permitting only the flow of working oil from the oil passage 85 into the damper chamber 39.

Again, with the eighth embodiment, it is possible to exhibit an effect similar to that in the above described seventh embodiment.

In the foregoing embodiments, the preferred valve operating systems for the intake valve 5 have been described, but it will be understood that the present invention can be likewise carried out even with a valve-operating system for an exhaust valve. In addition, the hydraulic pressure generating means may be any one which is constructed, not only to generate an oil pressure by the action of a cam as in the above-described individual embodiments but also to control the oil pressure from a hydraulic pressure generating source such as a hydraulic pump by a control valve to supply it into the damper chamber.

What is claimed is:

1. A valve-operating system for an internal combustion engine, comprising a valve-driving piston slidably received in a cylinder body and operatively connected at one end thereof to an engine valve which is spring-biased in a closing direction, and a check valve and an orifice means interposed between hydraulic pressure generating means of generating an oil pressure for causing opening of the engine valve and a damper chamber defined between the cylinder body and the valve-driving piston, said check valve permitting flow of a working oil only from said hydraulic pressure generating means to the damper chamber, and said orifice means restricting returning of the working oil from the damper chamber to the hydraulic pressure generating means, wherein said orifice means comprises a hole having a constant length in the direction of oil flow, said hole being made sufficiently small to substantially reduce an influence on the flow of the working oil through the hole caused by viscosity variations of the working oil.

2. A valve-operating system for an internal combustion engine, comprising a valve-driving piston slidably received in a cylinder body and operatively connected at one end thereof to an engine valve which is spring-biased in a closing direction, and a check valve and an orifice interposed between hydraulic pressure generating means for generating an oil pressure for causing opening of the engine valve and a damper chamber defined between the cylinder body and the valve-driving piston, said check valve permitting flow of a working oil only from said hydraulic pressure generating means to the damper chamber, and said orifice restricting returning of the working oil from the damper chamber to the hydraulic pressure generating means wherein said orifice is provided in a valve member of the check valve and is made sufficiently small to substantially reduce an influence on the flow of the working oil through the orifice caused by viscosity variations of the working oil.

3. A valve-operating system for an internal combustion engine, comprising a valve-driving piston slidably received in a cylinder body and operatively connected at one end thereof to an engine valve which is spring-biased in a closing direction, and a check valve and an orifice means interposed between hydraulic pressure generating means for generating an oil pressure for causing opening of the engine valve and a damper chamber defined between the cylinder body and the valve-driving piston, said check valve permitting flow of a working oil only from said hydraulic pressure generating means to the damper chamber, and said orifice means being provided in one of the cylinder body and the valve-driving piston for restricting returning of the working oil from the damper chamber to the hydraulic pressure generating means, wherein said orifice comprises a hole having a constant length in the direction of oil flow, said hole being made sufficiently small to reduce to an extremely small level an influence on the flow of the working oil through the hole caused by viscosity variations of the working oil.

4. A valve-operating system for an internal combustion engine according to claim 3, wherein said orifice is provided in the valve-driving piston.

5. A valve-operating system for an internal combustion engine according to claim 3, wherein said orifice is provided in the cylinder body.

6. A valve-operating system for an internal combustion engine according to claim 4 or 5, wherein there is provided a further orifice means a variable orifice whose opening area is reduced in response to movement of the valve-driving piston within the cylinder body in the direction to close the engine valve.

7. A valve-operating system for an internal combustion engine, comprising a valve-driving piston slidably received in a cylinder body and operatively connected at one end thereof to an engine valve which is spring-biased in a closing direction, and a check valve and an orifice means interposed between hydraulic pressure generating means for generating an oil pressure for causing opening of the engine valve and a damper chamber defined between the cylinder body and the valve-driving piston, said check valve permitting flow of a working oil only from said hydraulic pressure generating means to the damper chamber, wherein said orifice means comprises one of a variable orifice whose opening area is reduced in response to movement of the valve-driving piston within the cylinder body in the direction to close the engine valve and an invariable orifice whose opening area is constant despite the movement of the valve-driving piston within the cylinder body, said orifice means restricting return of the working oil from the damper chamber to the hydraulic pressure generating means, wherein said orifice means comprises a hole having a constant length in the direction of oil flow, and is made small enough to reduce to an extremely small level an influence on the flow of the working oil through the orifice means caused by viscosity variations of the working oil.

8. A valve operating system for an internal combustion engine according to claim 7 wherein the invariable orifice is circular and has a size represented by $L/D^2$ being equal to or less than 3, wherein L is the axial length of the orifice in the direction of oil flow and D is the diameter of the orifice.

9. A valve-operating system for an internal combustion engine, comprising, a valve-driving piston slidably received in a cylinder and operatively connected at one end thereof to an engine valve, hydraulic pressure generating means for generating an oil pressure in the cylinder to force the valve-driving piston in a direction for opening of the engine valve, a damper chamber defined between the cylinder and the valve-driving piston at least in a final valve-closing movement of the valve-driving piston, an orifice means communicating with said damper chamber for restricting the flow of the working oil from the damper chamber for controlling the valve closing, said orifice means having a small length in the direction of oil flow as compared to the cross-sectional flow area for minimizing any effect of variations in viscosity of the oil whereby the valve closing is substantially consistent under any oil viscosity variations, said orifice comprising a notch in a thin wall of the valve driving piston that cooperates with the cylinder to progressively cover said notch as the valve proceeds through the final closing movement.

10. A valve-operating system according to claim 9, wherein said notch is V-shaped to provide a progressively reducing orifice means size as the valve closes.

11. A valve-operating system according to claim 9, wherein said notch is rectangular in shape with a width W perpendicular to the direction of movement of the valve-driving piston and said length is L, and wherein $L/W^2$ is one or less.

12. A valve-operating system for an internal combustion engine, comprising, a valve-driving piston slidably received in a cylinder and operatively connected at one end thereof to an engine valve, hydraulic pressure generating means for generating an oil pressure in the cylinder to force the valve-driving piston in a direction for opening of the engine valve, a damper chamber defined between the cylinder and the valve-driving piston at least in a final valve-closing movement of the valve-driving piston, and an orifice means communicating with said damper chamber for restricting the flow of the working oil from the damper chamber for controlling the valve closing, said orifice means comprising a hole having a small constant length in the direction of oil flow as compared to the cross-sectional flow area for minimizing any effect of variations in viscosity of the oil whereby the valve closing is substantially consistent under any oil viscosity variations.

13. A valve-operating system for an internal combustion engine, comprising a valve-driving piston slidably received in a cylinder body and operatively connected at one end thereof to an engine valve which is spring-biased in a closing direction, and a check valve and an orifice interposed between hydraulic pressure generating means for generating an oil pressure for causing opening of the engine valve and a damper chamber defined between the cylinder body and the valve-driving piston, said check valve permitting flow of a working oil only from said hydraulic pressure generating means to the damper chamber, and said orifice restricting returning of the working oil from the damper chamber to the hydraulic pressure generating means, wherein said orifice is made sufficiently small to substantially reduced an influence on the flow of the working oil through the orifice caused by viscosity variations of the working oil and wherein the orifice has a size represented by $L/D^2$ being equal to or less than 3, wherein L is the axial length of the orifice in the direction of oil flow and D is the width of the orifice.

14. A valve-operating system for an internal combustion engine according to claim 13, wherein the orifice is circular and D is the diameter thereof.

15. A valve-operating system for an internal combustion engine, comprising a valve-driving piston slidably received in a cylinder body and operatively connected at one end thereof to an engine valve which is spring-biased in a closing direction, and a check valve and an orifice means interposed between hydraulic pressure generating means for generating an oil pressure for causing opening of the engine valve and a damper chamber defined between the cylinder body and the valve-driving piston, said check valve permitting flow of a working oil only from said hydraulic pressure generating means to the damper chamber, wherein said orifice means comprises one of a variable orifice whose opening area is reduced in response to movement of the valve-driving piston within the cylinder body in the direction to close the engine valve, said variable orifice formed such that its opening area becomes zero at the moved position of the valve-driving piston within the cylinder body which corresponds to a location just before seating of the engine valve, and an invariable orifice whose opening area is constant despite the movement of the valve-driving piston within the cylinder body, said orifice means restricting returning of the working oil from the damper chamber to the hydraulic pressure generating means, wherein said orifice means is made small enough to reduce to an extremely small level an influence on the flow of the working oil through the orifice means caused by viscosity variations of the working oil.

16. A valve-operating system for an internal combustion engine, comprising, a valve-driving piston slidably received in a cylinder and operatively connected at one end thereof to an engine valve, hydraulic pressure generating means for generating an oil pressure in the cylinder to force the valve-driving piston in a direction for opening of the engine valve, a damper chamber defined between the cylinder and the valve-driving piston at least in a final valve-closing movement of the valve-driving piston, and an orifice means communicating with said damper chamber for restricting the flow of the working oil from the damper chamber for controlling the valve closing, said orifices means having a small length in the direction of oil flow as compared to the cross-sectional flow area for minimizing any effect of variations in viscosity of the oil whereby the valve closing is substantially consistent under any oil viscosity variations, said orifice means comprising a round hole of a diameter D and a length L, and wherein $L/D^2$ is equal to or less than 3.

* * * * *